US005497556A

United States Patent [19]

Lebessis

[11] Patent Number: 5,497,556

[45] Date of Patent: Mar. 12, 1996

[54] RIPPING TOOL

[76] Inventor: Elias Lebessis, Furfürstenstrasse 16, Germering, Germany, D-82110

[21] Appl. No.: 271,139

[22] Filed: Jul. 6, 1994

[30] Foreign Application Priority Data

Jul. 14, 1993 [DE] Germany ..... 43 23 580.8

[51] Int. Cl.[6] ..... B44C 7/02

[52] U.S. Cl. ..... 30/365; 30/366

[58] Field of Search ..... 30/365, 366, 307, 30/319, 321, 169, 172; 15/236.1; 172/349; 56/255, 295

[56] References Cited

U.S. PATENT DOCUMENTS 958,809 5/1910 Hawkins ..... 30/307
2,474,451 6/1949 Zabel et al. ..... 30/307
4,502,223 3/1985 Brookfield ..... 30/365
5,074,045 12/1991 Brookfield ..... 30/365 X

FOREIGN PATENT DOCUMENTS 0077669 10/1992 European Pat. Off. .
2927677 7/1979 Germany .

*Primary Examiner*—Douglas D. Watts
*Attorney, Agent, or Firm*—Meltzer, Lippe, Goldstein

[57] ABSTRACT

A ripping tool, particularly for the paper-hanging trade, to rip existing water-resistant wall-paper before removal of same. The ripping tool is characterized by a spiked roller which is split in two to form at a spiked roller pair which can be rolled over the surface of the existing wall-paper. The elements of the spiked roller pair are forcibly and oppositely displaced, along a common axial direction during the rolling process.

15 Claims, 3 Drawing Sheets

RIPPING TOOL

FIELD OF THE INVENTION

The present invention relates to a ripping tool, more particularly, a ripping tool for use in the paper-hanging trade to rip old water repellent or water-impermeable wallpaper before it is removed.

BACKGROUND OF THE INVENTION

Layers of materials are pasted on flat supporting materials for a variety of purposes by using water-soluble adhesives. The water-solubility of the adhesives used in that case is intended to make it possible to remove the covering material from the bearing support on which it is pasted. Wallpaper, posters, temporarily needed information panels or temporary covers and sheathing are examples of such layers of material. To ensure optimal adhesion, such a covering material itself impermeable to water or water-repellent or it is provided with an impermeable or water-repellent coating. By its very nature this makes it more difficult to detach and wash off the layers of material pasted on the wall. In order to gain access to the water-soluble adhesive layer located underneath the water-repellent surface of the covering material, the covering material be started and torn laboriously by hand, usually with the help of a spatula.

It is the object of the present invention to create a ripping tool which opens, with relative ease, very large surfaces of water-resistant, impermeable or water-repellent wall coverings or other pasted layers of material so that water applied to the surface of the covering material reaches the layer of adhesive below the covering material in such quantity that the pasted material can be loosened effectively.

SUMMARY OF THE INVENTION

To attain this object the invention creates a ripping tool with the characteristics indicated in claim 1.

The present invention is based on a spiked roller which is freely rotatable and mounted on a handle that can be freely rolled over the covering material to be removed which then perforates the covering material. The essential idea of the invention consists in subdividing the spiked roller into an even number of roller parts, i.e. in dividing it at least in two to form roller pairs. Cams are used to impart forces to every element of the roller pairs which are displaced alternately towards or away from each other along their common axes. This makes it possible to achieve precise linear rolling of the spiked roller and at the same time, due to the forced axial displacement during the rolling process, to cause lateral ripping through the covering material by the spike tip of the spiked roller.

By rolling a spiked roller of the present invention, a surface evenly covered with closely spaced perforated tears is produced on the covering material. The distribution pattern of these tears is determined by the placement and distribution of the spikes on the roller. The selection of the optimal distribution pattern is determined by the application, that can be determined and set by the application specialist and is therefore not a direct object of the invention.

It is essential that not only a perforation with substantially circular perforations is produced, such as when rolling a conventional spiked roller, but that the axial displacement of the split rollers of the spiked roller in opposite directions causes slit-shaped perforations to be produced by tearing. The slit perforations not only allowing for better and more effective access to the adhesive layer below the covering material, but by ripping the covering material itself, render the latter more susceptible to attack by dissolution or swelling.

It is advantageous for the ripping process if the two rollers of the roller pair of the spiked roller are non-rotatably connected to each other via a plain bearing journal which is not dynamically balanced.

The axial displacement of the roller pair is preferably effected by means of cam guides which are fixedly formed or mounted on the tool housing between the end faces of each element of the roller pair and their associated bearing block surfaces. Such a cam guide may be provided on one side of each element of the roller pair against a spring force. The cam guides are preferably formed on either side of each element of the roller pair, such that axial displacement cannot occur without rotation of the roller pair.

In order to limit the wear of the spike tips against the supporting surface below the adhesive, another embodiment of the present invention provides for free rolling spacing disks or spacing wheels. The spacing disk can be installed at or on the plain bearing shaft of the roller pair. The spacing disk rolls over the surface of the cover material without penetrating the covering material substantially. The outside diameter of the cylinder circumference defined by the spike tips of the roller pair is slightly larger than the diameter of the spacing disk at least by the thickness of the cover material to be torn up. This prevents any damage from the tearing spike tips to the supporting base, e.g. the plaster surface, even when the ripping tool is pressed down heavily on the surface of the cover material.

Finally, in order to prevent injury, another embodiment of the present invention is preferably equipped with a protective housing that is substantially cylindrical and which surrounds the spiked roller together with all its appertaining functional parts, i.e. surrounding the spacing disks completely. This housing is preferably divided into two parts. One that one part of the protective housing is capable of swivelling around the plain bearing shaft of the spiked roller so that the spiked roller is completely enclosed when the protective housing is in a closed position. The same pan of the protective housing is then swivelled to expose the spiked roller pair so that the pair may be rolled as intended.

The invention is described in further detail below through an example of an embodiment and in combination of the drawings.

DESCRIPTION OF THE PREFERRED EMBODIMENT

The embodiment of the ripping tool shown in FIGS. 1 to 4 consists essentially of a spiked roller 1 which is divided in two and whose two roller elements 2, 3 are on a common traversing plain bearing shaft 4 so as to be freely rotatable. The two roller elements 2, 3 are non-rotatably coupled together by a plain bearing journal 5 having a four-edged profile so that the roller elements are capable of axial displacement in relation to each other.

Figure 6:
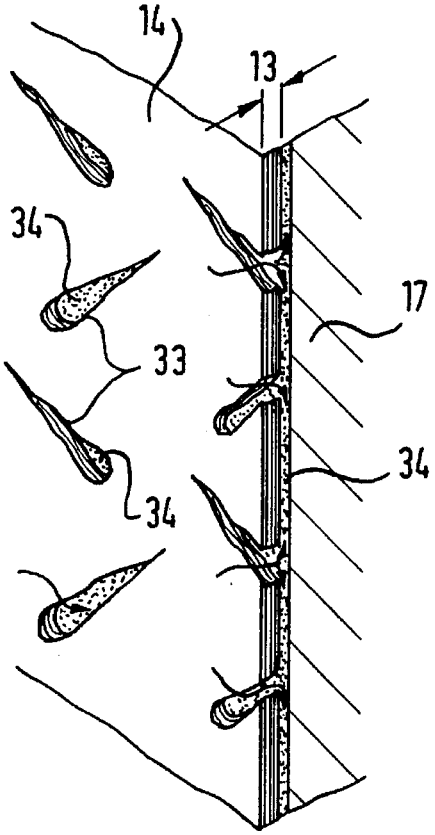
FIG. 6 shows a perspective sectional view of an enlarged detail of the tear pattern shown in FIG. 5.

Along the common axis of the two roller elements, outside of the two axially outermost end faces 9, 10 of the spiked roller 1, a disk 11, 12 is rotatably mounted in each of the bearing blocks 6, 7. The diameter of disks 11, 12, which are provided with circumferential ribbing, is smaller by thickness 13 of the wallpaper 14 to be torn up (FIG. 6) than the circular diameter defined by the tips 15 of the spikes 16 of the spiked roller 1. This ensures that the spike tips 15 cannot be worn against the surface of the mortar layer 17 (FIG. 6) as the ripping tool is rolled.

The spiked roller 1 with its disks 11 and 12 and the bearing blocks 6, 7, 8 is enclosed by a protective housing 18 consisting of the two housing parts 19, 20. The housing part 20 is mounted so that it is able to swivel on the plain bearing shaft 4 into and out of the other housing part 19. By swivelling the housing part 20 in the direction of arrow 21 (FIG. 2) the spiked roller can be covered completely so that there is no danger of injury from the ripping tool when it is not being used.

To use the ripping tool the protective housing part 20 can be swivelled into the housing part 19 (FIG. 3) so that the spiked roller 1 may be rolled on the surface of the old wallpaper 14.

A handle 22 is attached to the protective housing part 19 and is used to guide the ripping tool on the surface of the wallpaper 14 as it is being rolled.

Figure 3:
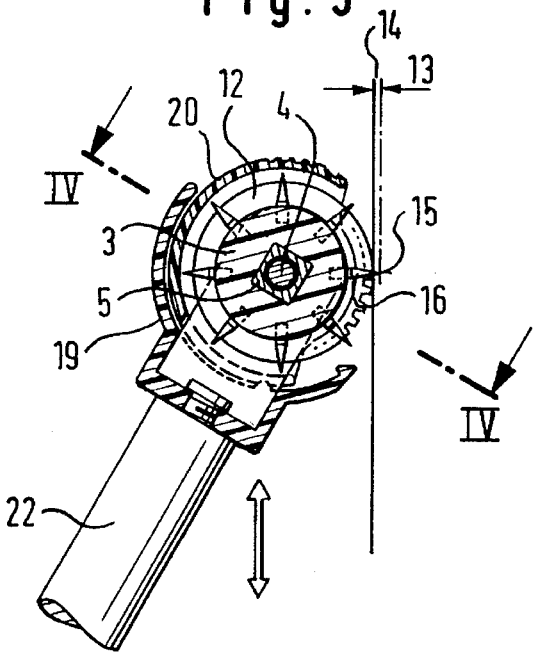
FIG. 3 shows an axial section of the present invention during operation.

As the ripping tool is rolled over the surface of the old wallpaper 14 the spike tips 15 pierce the wallpaper 14 in the manner shown in FIG. 3 so that the spiked roller 1 is forcibly rotated on the plain bearing shaft 4.

Figure 1:
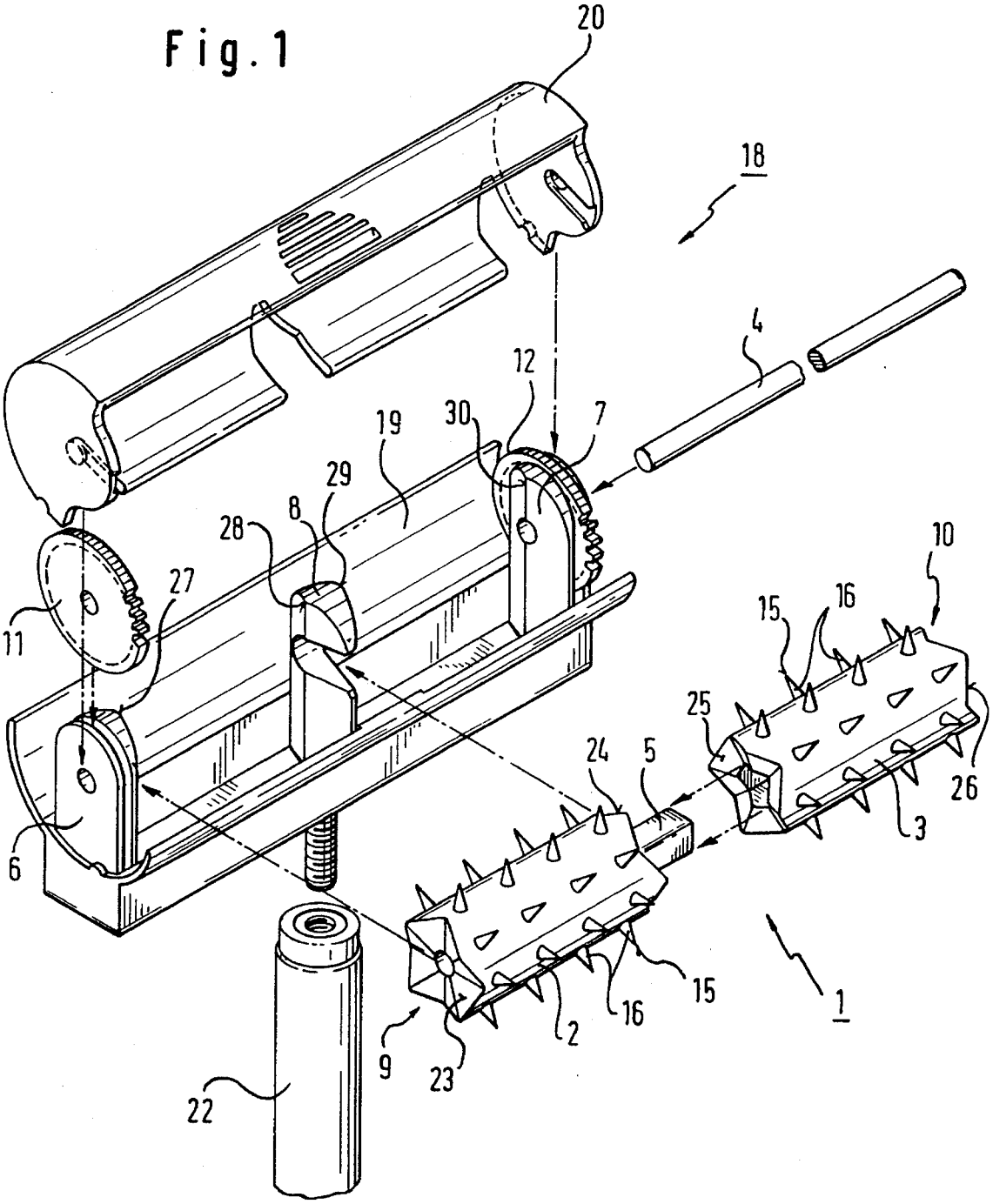
FIG. 1 shows a ripping tool of the present invention, in perspective and exploded representation.
Figure 2:
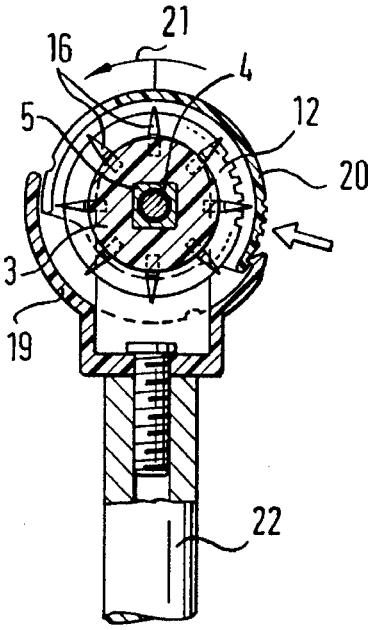
FIG. 2 shows an axial section of the tool shown in FIG. 1, in assembled state.
Figure 4:
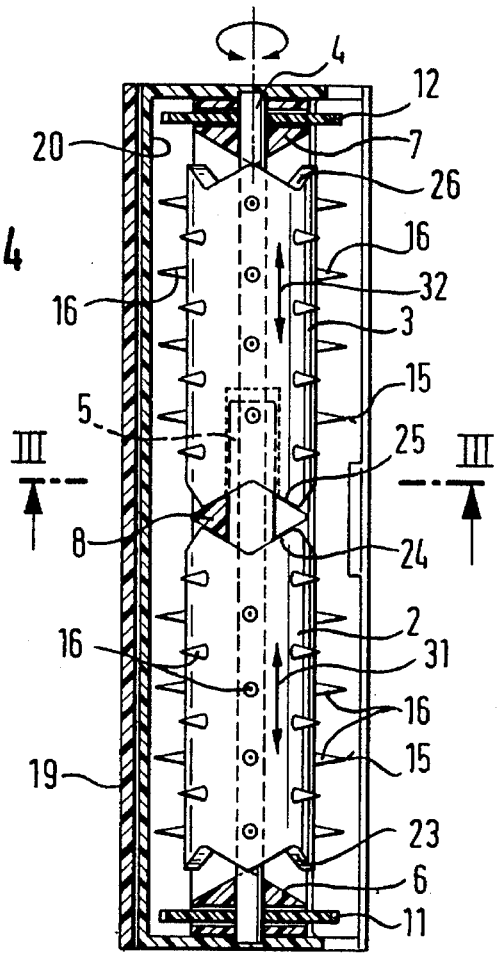
FIG. 4 shows a section along IV—IV in FIG. 3.

In a manner shown in particular in FIGS. 1 and 4, each of the two roller elements 2, 3 is mounted at its ends against one of the bearing blocks 6, 8 or 8, 7 respectively. At each end of the roller elements 2, 3, cam surfaces 23, 24 or 25, 26 are formed and interact with the cams 27, 28, 29, 30 which are formed on the respective adjoining radial surfaces of the bearing blocks 6, 7, 8. These four cams and the four associated cam surfaces are made, sized and coordinated with each other as shown in FIG. 4 to form a cam control mechanism so that the two roller elements 2, 3, that are capable of axial displacement, are fixed and prevented from axial displacement without rotation of these roller elements 2, 3 for every angle-of-rotation.

Figure 5:
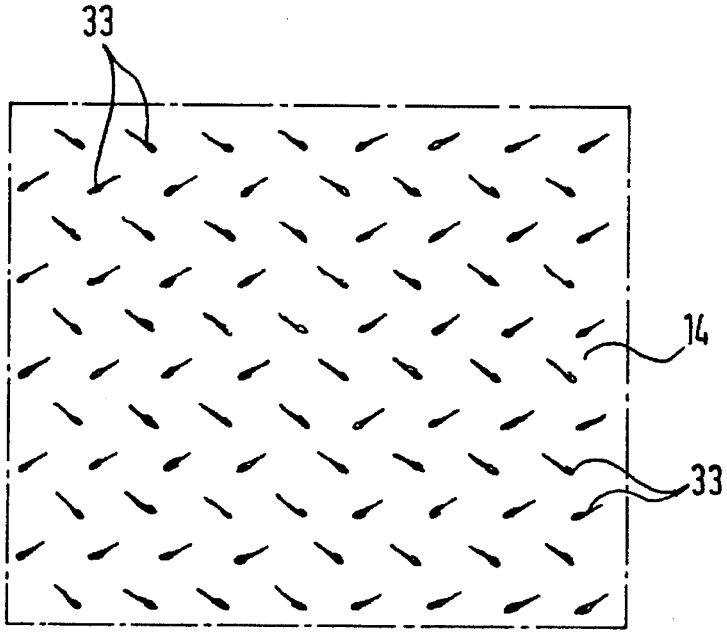
FIG. 5 shows a detail of a surface of an old wall-paper on which the present invention has been rolled in the manner shown in FIG. 3

The roller elements 2, 3 are forced to slide non-rotatably and axially in relation to each other in opposite axial directions along arrows 31, 32 as they are guided by the cam control and by the plain bearing shaft 5. This axial translation of the spiked rollers causes the old wallpaper to be ripped down to the adhesive layer 34 by producing tears 33 which widen to form tear drops when seen in profile. In this process the ripping tool produces a tight and uniform pattern of such tears (FIG. 5) by being rolled only one time over the surface of the old wallpaper. Subsequent wetting of the old wallpaper surface with water then results in the rapid dissolution of the adhesive 34 over wide areas.

I claim:

1. A ripping tool comprising:

a handle;

a spiked roller, said spiked roller mounted rotatably along an axis on said handle, said spiked roller constructed and arranged to be passively rotated when said spiked roller is rolled over the surface of a layered material, said spiked roller further being divided into at least one roller pair consisting of two roller elements;

said roller elements of a roller pair capable of axial displacement in relation to each other along said axis of said spiked roller, said roller elements guided in axial displacement by cams;

wherein said roller elements are alternately axially displaced toward and away from each other as said spiked roller is rolled over said surface of said layered material.

2. A ripping tool as in claim 1, wherein said roller elements are mounted non-rotatably in relation to each other.

3. A ripping tool as in claim 1 further having:

a plain bearing shaft;

two end faces on each of said roller elements;

cam surfaces on each of said end faces of said roller elements;

two bearing blocks, said roller elements mounted between said bearing blocks on said plain bearing shaft, said bearing blocks provided with cams constructed and arranged to engage said cam surfaces of said roller elements whereby said axial displacement of said roller elements is controlled by the engagement of said cams with said cam surfaces when said spiked roller is rolled.

4. A ripping tool as in claim 1 further having:

a plain bearing shaft;

two end faces on each of said roller elements;

cams on each of said end faces of said roller elements;

two bearing blocks, said roller elements mounted between said bearing blocks on said plain bearing shaft, said bearing blocks provided with cam surfaces constructed and arranged to engage said cam surfaces of said roller elements whereby said axial displacement of said roller elements is controlled by the engagement of said cams with said cam surfaces when said spiked roller is rolled.

5. A ripping tool as in claim 3 wherein said cam surfaces on said end faces of said roller elements are constructed and arranged to prevent axial displacement without rotation of said roller elements.

6. A ripping tool as in claim 4 wherein said cams on said end faces of said roller elements are constructed and arranged to prevent axial displacement without rotation of said roller elements.

7. A ripping tool as in claim 3 wherein said roller elements are mounted on said plain bearing shaft.

8. A ripping tool as in claim 4 wherein said roller elements are mounted on said plain bearing shaft.

9. A ripping tool as in claim 3 further having:

a plain bearing journal, said plain bearing journal not being dynamically balanced in its cross-section, said plain bearing journal mounted on said plain bearing shaft.

10. A ripping tool as in claim 4 further having:

a plain bearing journal, said plain bearing journal not being dynamically balanced in its cross-section, said plain bearing journal mounted on said plain bearing shaft.

11. A ripping tool as in claim 9 further having:

a bearing block located between said roller elements, said bearing block supports said plain bearing journal so that said plain bearing journal is freely rotatable.

12. A ripping tool as in claim 10 further having:

a bearing block located between said roller elements, said bearing block supports said plain bearing journal so that said plain bearing journal is freely rotatable.

13. A ripping tool as in claim 3 further having:

a plurality of spike tips on said roller elements, said spike tips on said roller elements forming a spike cylinder having a spike radius;

at least two disks, said disks having a disk radius, said disks mounted rotatably along the same axis as said roller elements on said plain bearing shaft, said disks able to freely roll on said layered surface, said disks are sized such that said disk radius is smaller than said spike radius by the thickness of the wallpaper.

14. A ripping tool as in claim 4 further having:

a plurality of spike tips on said roller elements, said spike tips on said roller elements forming a spike cylinder having a spike radius;

at least two disks, said disks having a disk radius, said disks mounted rotatably along the same axis as said roller elements on said plain bearing shaft, said disks able to freely roll on said layered surface, said disks are sized such that said disk radius is smaller than said spike radius by the thickness of the wallpaper.

15. A ripping tool as in claim 1 wherein a substantially cylindrical protective housing is attached to said handle, said protective housing encloses said spiked roller, said protective housing able to expose said spiked roller to enable the operator to roll said spiked roller on wallpaper.

* * * * *

UNITED STATES PATENT AND TRADEMARK OFFICE

CERTIFICATE OF CORRECTION

PATENT NO. : 5,497,556

DATED : March 12, 1996

INVENTOR(S) : Elias Lebessis

It is certified that error appears in the above-indentified patent and that said Letters Patent is hereby corrected as shown below:

On the title page item [76], change the inventor's address from "Furfürstenstrasse 16" to -- Kurfürstenstrasse 16 --

Signed and Sealed this

Twenty-third Day of July, 1996

*Attest:*

*Attesting Officer*

BRUCE LEHMAN

*Commissioner of Patents and Trademarks*